US005782656A

United States Patent [19]

Zell et al.

[11] Patent Number: 5,782,656

[45] Date of Patent: Jul. 21, 1998

[54] PLUG-TYPE CONNECTOR FOR BACKPLATE WIRINGS

[75] Inventors: Karl Zell, Niederpoecking; Juergen Seibold, Baierbrunn; Peter Seidel, Groebenzell, all of Germany

[73] Assignee: Siemens Aktiengesellschaft, Munich, Germany

[21] Appl. No.: 420,212

[22] Filed: Apr. 11, 1995

[30] Foreign Application Priority Data

Apr. 14, 1994 [DE] Germany ..... 44 12 975.0

[51] Int. Cl.[6] ..... H01R 13/00

[52] U.S. Cl. ..... 439/579; 439/608

[58] Field of Search ..... 439/607–610, 439/98, 99, 101, 108, 66, 65, 74, 75, 581, 682

[56] References Cited

U.S. PATENT DOCUMENTS

| | | | |
|---|---|---|---|
| 4,605,269 | 8/1986 | Cohen et al. | 439/581 |
| 4,628,652 | 12/1986 | Wefels | 53/306 |
| 5,037,332 | 8/1991 | Wilson | 439/608 |
| 5,201,855 | 4/1993 | Ikola | 439/608 |
| 5,211,567 | 5/1993 | Neumann et al. | 439/608 |
| 5,273,457 | 12/1993 | Zell et al. | 439/581 |
| 5,330,371 | 7/1994 | Andrews | 439/608 |
| 5,344,340 | 9/1994 | Bouleau | 439/581 |
| 5,399,108 | 3/1995 | Lu et al. | 439/682 |
| 5,516,307 | 5/1996 | Cartesse et al. | 439/581 |

FOREIGN PATENT DOCUMENTS 0 103 192 6/1986 European Pat. Off. .

*Primary Examiner*—Hien Vu

*Attorney, Agent, or Firm*—Hill & Simpson

[57] ABSTRACT

The invention is directed to a plug-type connector for backplane wirings, composed of blade connector and spring clip, wherein the individual contact springs are surrounded by electrically conductive shielding plates that are connected to contactings applied in the intermediate grid both at the backplane side as well as at the assembly side, these contactings being charged with an appropriate potential. In order to obtain a comparatively simple structure of the spring clip, the spring clip (1) is composed of through receptacle chambers into which metallic tubes (4) can be inserted, wherein contact springs (5) extrusion-coated with plastic (12) can be placed into the tubes (4).

2 Claims, 2 Drawing Sheets

PLUG-TYPE CONNECTOR FOR BACKPLATE WIRINGS

BACKGROUND OF THE INVENTION

The present invention is generally directed to a plug-type connector for backplane wirings. More specifically, the present invention relates to such a connector having a blade connector portion fashioned as a rectangular housing open at one side for plugging onto the blades of a wiring backplane and a mated spring clip portion pluggable into the blade connector portion and provided with receptacle chambers and firmly joined to an assembly PC board.

Because of ever-increasing data transmission rates with higher and higher frequencies at the interface formed by a plug-type connector, such connectors must be adapted to meet present and future demands. Particularly, it is necessary to upgrade the plug bodies, which are currently manufactured of plastic, and make them electromagnetically compatible. The plug passage should be smaller and less expensive than a traditional mini-coax.

Up to now, the necessary electromagnetic compatibility was achieved, on the one hand, with the assistance of normal contact pins around an active conductor and, on the other hand, by encapsulation of the individual contact passages with shield elements connected to form a potential cage or electromagnetic shield. Such a conventional plug-type connector is disclosed in European Patent Application 94103192.4 which includes a complicated structure to manufacture.

SUMMARY OF THE INVENTION

An object of the present invention is to provide a plug-type connector having improved high-frequency properties which meet the increased demands. A further object is to provide such a connector having a comparatively simple structure.

These objects are achieved by providing a connector having a spring clip portion housing having continuous receptacle chambers into which metallic tubes can be introduced. Also, the connector has contact springs which are extrusion-coated with plastic and placed into a tube that the middle conductor is centrally seated relative to the tube.

In an embodiment, the blades and springs are arranged parallel in a plurality of rows, and wherein the individual contact springs are surrounded by electrically conductive shielding plates that are connected to contactings applied in an intermediate grid region both at the backplane side as well as at the assembly side, said contactings being charged with an appropriate potential.

An embodiment of the plug-type connector according to the present invention includes plug passages that are significantly smaller and less expensive than traditional mini-coax plug-type connectors, and still meets all current demands with respect to the transmission properties.

An advantage of the plug-type connector of the present invention is that the contactings are formed of contact pins firmly anchored in a press-in manner both in a wiring backplane and in an assembly printed circuit board. The contact pins are respectively impressed into a wire weave in their plugged condition that is attached in recesses provided between ends of the tubes. A very good shield conductance in an intermediate grid is assured in this way.

Another advantage of the present invention is that the ends of the tubes are cut out essentially in the shape of a circular arc at four locations lying diagonally opposite one another, wherein sections that are not cut out serve the purpose of shield contacting. The current flow properties are improved by the cut-outs—an eddy formation and, thus, an additional resistance are largely avoided.

Additional features and advantages of the present invention are described in, and will be apparent from, the Detailed Description of the Presently Preferred Embodiments and from the drawings.

DETAILED DESCRIPTION OF THE PRESENTLY PREFERRED EMBODIMENTS

Figure 1:
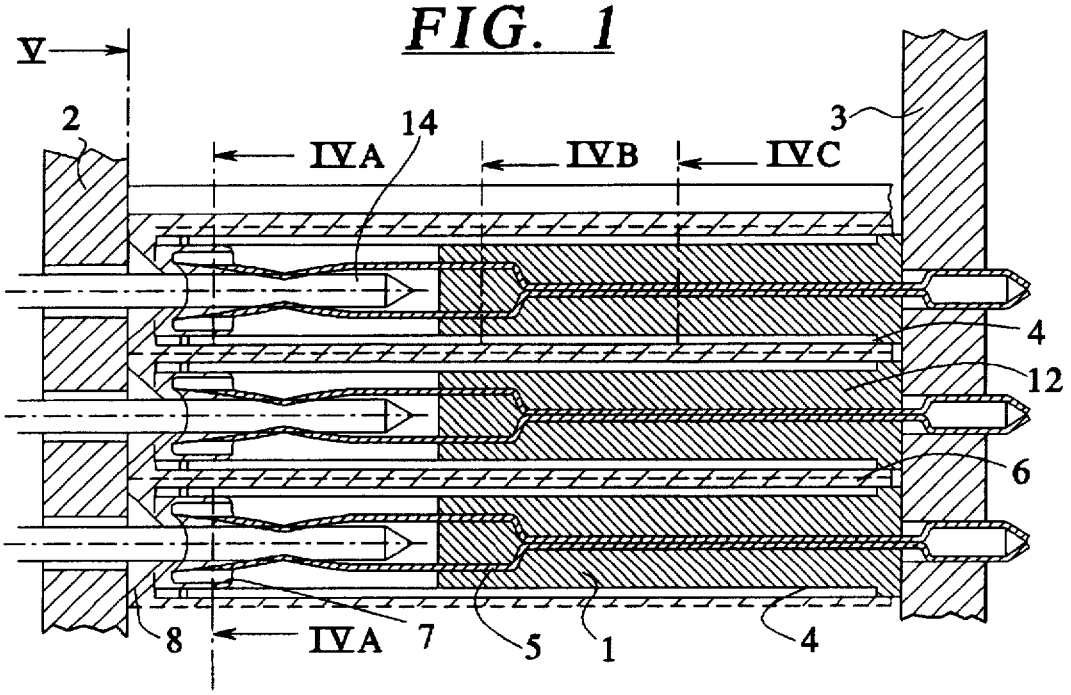
FIG. 1 is a longitudinal sectional view through an embodiment of a plug-type connector according to the present invention.

It is mainly a spring clip 1 of the plug-type connector of the present invention that is shown. The spring clip 1 is located between a wiring backplane 2 of an assembly carrier and an assembly printed circuit board 3 of an assembly. The blade connector is merely suggested in FIG. 1. The spring clip 1 is essentially composed of a plastic body having a plurality of receptacle chambers. The respective chambers proceed through from one side to the other and are separated from one another by chamber partitions 6 of plastic.

Metallic tubes 4 into which contact springs 5 extrusion-coated with plastic are placed such that the middle conductor is centrally seated relative to the tube 4 can be inserted into the receptacle chambers. As may be seen from FIG. 1, the extrusion coat begins at the assembly side and ends in the back spring region in order to fully preserve the spring properties of the contact springs 5. In order to enable a designational insertion of the tubes and simultaneously avoid a short of the front part of the contact springs with the tube, the receptacle chamber can include a spring leg detent 7 for the contact springs at the backplane side. Each spring leg detent 7 simultaneously serves as an entry funnel 8 for the respective contact blade 14. The metallic tubes 4 can comprise both a round as well as a rectangular or square cross-section.

Figure 2:
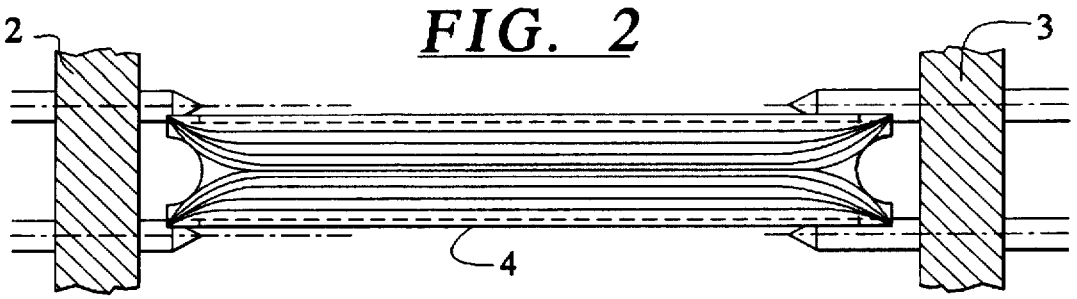
FIG. 2 is a fragmentary sectional view of the embodiment of FIG. 1, the section being taken along a plane parallel, but offset, relative to the section of FIG. 1.

Referring to FIG. 2, the contacting of the metallic tubes 4 to a ground or, respectively shielding potential ensues via contacts in the diagonal, i.e. an intermediate grid. In conventional plug-type connectors, this grid amounts to 1.25 mm. The ground or, respectively, shielding potential contacts are firmly anchored in the housing at the assembly side and are implemented in the known press-in technique in the assembly printed circuit board. A corresponding contact is likewise provided in the wiring backplane.

Recesses 13 in the plastic housing of the spring clip 1 are provided at the respective ends of the metallic tubes 4, so that the surfaces of respectively four tubes are accessible for the contacting.

Figure 3:
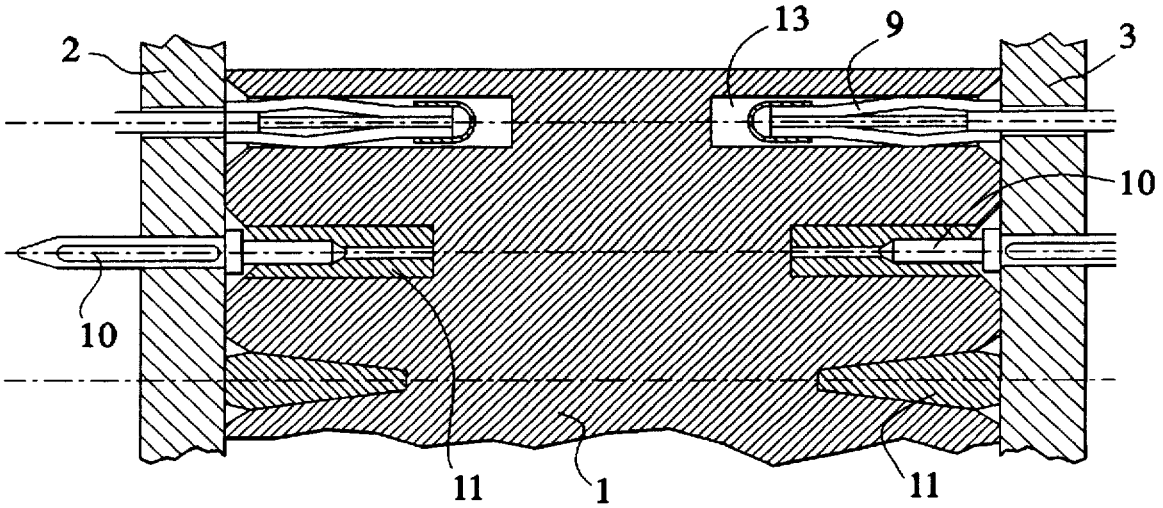
FIG. 3 is a partial longitudinal section through the plug-type connector of FIG. 1 between the receptacle chambers.

As shown in FIG. 3, the contacting to the tubes 4 can ensue in at least three different ways. A first possibility for contacting is comprised therein that a bunch plug 9 is firmly anchored in the printed circuit board in a press-in manner and projects into the recess 13. Another type of contacting is comprised therein that a wire weave or contact wool is introduced into the recess and respective contact pins are firmly anchored in the board 3 and backplane 2. In the plugged condition, these contact pins 10 project into the wire weave 11 or, respectively, into the contact wool.

A further possibility of contacting is comprised therein that a wire weave or, respectively, a contact wool introduced into the recesses ensues directly onto a contact surface or pads of the printed circuit boards. A press-in procedure is eliminated in such an embodiment.

Figure 4:
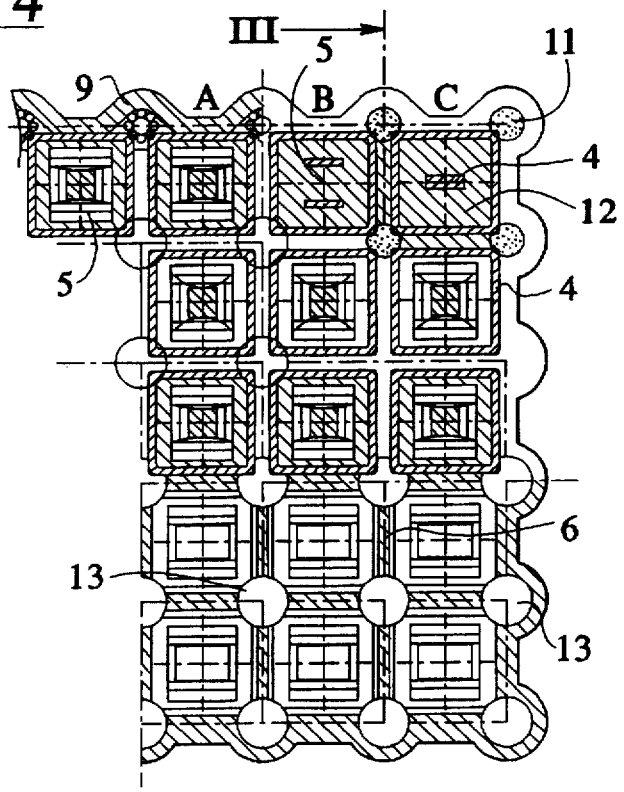
FIG. 4 is a partial plan view and onto the spring clip of FIG. 1 onto the backplane side and a number of partial cross-sections.
Figure 5:
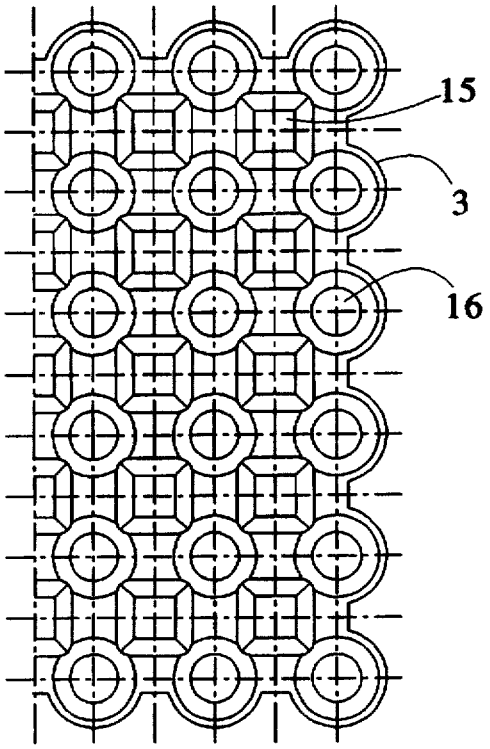
FIG. 5 is a plan view onto the assembly pc board.

FIG. 5 schematically shows a plan view onto an assembly PC board 3, illustrating the openings 15 for the contact springs 5 and the openings 16 for the shield contacting pins. FIG. 4 shows a plan view onto a spring clip 1 at the backplane side as well as a plurality of partial sections in the planes of section A, B and C.

As shown in FIG. 2, in order to further reduce the contact resistance at the contact locations for the ground potential or, respectively, shielding conductance, the tube ends are cut out essentially in the shape of a circular arc at four locations lying diagonally opposite one another in addition to the above-recited measures. The tubes are cut out such that the uncut sections form the limitation of the recess, i.e. serve the purpose of shield contacting. The flow behavior of the current is thereby improved. An eddy formation and, thus, an additional resistance are largely avoided by the design measure. It thereby also becomes possible to bring the transition from tube to pin of the printed circuit boards as close as possible to the grounded potential layer of the boards and thus keep the common line length with the neighboring tube as slight as possible because of a potential reflux into the neighboring tube.

It should be understood that various changes and modifications will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A shielded plug-type connector connectable between a wiring backplane and a printed circuit board, the connector comprising:

a plurality of parallel receptacle chambers arranged in at least one row:

a plurality of continuous metal tubes each having a rectangular cross-section, one of the tubes being arranged in each receptacle chamber;

a plurality of conductive contact springs, each contact spring having a backplane end insertable onto a contact blade extending from the wiring backplane and an opposite circuit board end being engageably connectable to the printed circuit board, each contact spring being disposed in one of the tubes, an insulative extrusion coating surrounding at least a portion of each contact spring to seat the contact springs generally centrally within the respective tubes so that the contact springs are insulated from the tubes;

each metal tube adapted at opposite ends to connect to one or more of a plurality of shield contacts charged with a shield voltage, the shield contacts extending from the backplane and the printed circuit board; and wherein the opposite ends of each of the tubes has four arcuate cut out sections lying diagonally opposite one another, wherein each tube contacts the respective shield contacts between the cutouts.

2. The plug-type connector according to claim 1 wherein each receptacle chamber further comprises:

a spring leg detent at the backplane end of each contact spring, each detent being shaped as an entry funnel to guide the contact blades upon insertion.

* * * * *